US011370584B2

(12) United States Patent
Ludwig et al.

(10) Patent No.: US 11,370,584 B2
(45) Date of Patent: Jun. 28, 2022

(54) MULTI-CHAMBER POUCH AND VALVES

(71) Applicant: ILLINOIS TOOL WORKS INC., Glenview, IL (US)

(72) Inventors: Christopher Ludwig, Buffalo Grove, IL (US); Michal Gawlik, Rolling Meadows, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/261,630

(22) PCT Filed: Jul. 22, 2019

(86) PCT No.: PCT/US2019/042762

§ 371 (c)(1),
(2) Date: Jan. 20, 2021

(87) PCT Pub. No.: WO2020/023348

PCT Pub. Date: Jan. 30, 2020

(65) Prior Publication Data

US 2021/0292054 A1 Sep. 23, 2021

Related U.S. Application Data

(60) Provisional application No. 62/711,025, filed on Jul. 27, 2018.

(51) Int. Cl.
*B65D 47/20* (2006.01)
*B65D 81/32* (2006.01)

(52) U.S. Cl.
CPC ..... *B65D 47/2018* (2013.01); *B65D 81/3261* (2013.01)

(58) Field of Classification Search
CPC ..... B65D 47/2018; B65D 81/3261
See application file for complete search history.

(56) References Cited

U.S. PATENT DOCUMENTS 4,274,556 A * 6/1981 Thiessen ..... F16N 37/00 222/323
4,592,493 A * 6/1986 Smith ..... B65D 47/2031 251/75

(Continued)

FOREIGN PATENT DOCUMENTS

CN 1042878 6/1990
CN 101247992 8/2008

(Continued)

OTHER PUBLICATIONS

International Search report issued in PCT/US/2019/042762 dated Nov. 12, 2019.

*Primary Examiner* — Frederick C Nicolas
(74) *Attorney, Agent, or Firm* — McCarter & English, LLP

(57) ABSTRACT

The present disclosure relates to pouches or packages with at least two separate storage volumes, wherein a bubble valve, protruding element valve or pressure actuated valve is provided for each storage volume. The two bubble valves may be presented in parallel configuration, angled slightly toward each other, or at right angles to each other. The bubble valves may also have different sized openings in order to adjust the proportion of products mixed and to adjust for differing viscosities.

18 Claims, 5 Drawing Sheets

(56) References Cited

U.S. PATENT DOCUMENTS

| | | | | |
|---|---|---|---|---|
| 4,765,512 | A * | 8/1988 | Bull, Jr. | B67D 1/0001 222/100 |
| 6,412,660 | B1 * | 7/2002 | Bouix | B65D 47/10 222/145.5 |
| 6,752,264 | B2 * | 6/2004 | Versluys | B65D 75/5883 206/219 |
| 7,207,717 | B2 | 4/2007 | Steele | |
| 7,883,268 | B2 | 2/2011 | Steele | |
| 8,083,103 | B2 * | 12/2011 | LaFlamme | B65D 81/3261 222/145.5 |
| 8,613,547 | B2 | 12/2013 | Steele | |
| 9,963,284 | B2 | 5/2018 | Steele | |
| 2002/0130138 | A1 * | 9/2002 | Crozet | B65D 81/3261 222/107 |
| 2002/0166779 | A1 * | 11/2002 | Etesse | B65D 75/566 206/219 |
| 2003/0121936 | A1 * | 7/2003 | De Laforcade | B65D 81/32 222/153.07 |
| 2005/0109796 | A1 * | 5/2005 | Bourque | B65D 75/008 222/129 |
| 2006/0163282 | A1 * | 7/2006 | Suzuki | B05B 11/3011 222/94 |
| 2008/0123465 | A1 * | 5/2008 | Heusser | B65D 81/3283 366/162.3 |
| 2008/0223875 | A1 | 9/2008 | LaFlamme et al. | |
| 2014/0228785 | A1 * | 8/2014 | Soll | A61J 1/062 604/310 |
| 2016/0297571 | A1 * | 10/2016 | Steele | B65D 33/16 |

FOREIGN PATENT DOCUMENTS

| | | |
|---|---|---|
| CN | 201923484 | 8/2011 |
| CN | 107531363 | 1/2018 |
| FR | 2915739 | 11/2008 |
| WO | 2008/112737 | 9/2008 |
| WO | 2018/194714 | 10/2018 |
| WO | PCT/US2017/061500 | 10/2018 |
| WO | 2018/232066 | 12/2018 |
| WO | 2018/232069 | 12/2018 |
| WO | PCT/US2018/037461 | 12/2018 |
| WO | PCT/US2018/037466 | 12/2018 |

* cited by examiner

MULTI-CHAMBER POUCH AND VALVES

This is a National Phase application of PCT/US2019/042762 filed on Jul. 22, 2019 which claims priority under 35 U.S.C. 119(e) of U.S. provisional application Ser. No. 62/711,025, filed Jul. 27, 2018, the contents of which is hereby incorporated by reference in its entirety and for all purposes.

BACKGROUND OF THE DISCLOSURE

Field of the Disclosure

The present disclosure relates to pouches or packages with at least two separate storage volumes, wherein a bubble valve, protruding element valve, or pressure actuated valve is provided for each storage volume.

Description of the Prior Art

The prior art includes bubble valves developed as a solution for containing liquids within flexible packaging with the object of using a flexible to semi-rigid, controllable method of containment of liquid, semi-liquid or similar products. Traditional packaging in the food/beverage, personal care and household care industries is typically a combination of a rigid bottle or semi-flexible tube with a rigid fitment or cap of varying dispenser types. Transition to flexible pouches for the main body of the container has continued to utilize similar rigid fitments. There is a need within these industries to complete the transition in order to create a fully flexible solution. Such a solution would improve functionality by representing both a flow control mechanism and re-close feature, enhance the overall sustainability profile and cost reduction of the packaging through material reduction and operational efficiency gains, and improved performance expectations in the e-commerce market.

Representative embodiments of a bubble valve or a pressure-activated valve are disclosed in PCT/US2018/037466 entitled "Three-Chamber Bubble Valve," filed on Jun. 14, 2018; PCT/US2018/037461 entitled "Pouch Flip-Top for Bubble Valve Applications," filed on Jun. 14, 2018; PCT/US2017/61500 entitled "Bubble Valve for Flexible Packaging," filed on Nov. 14, 2017; U.S. Pat. No. 9,963,284 entitled "Package Valve Closure System and Method," issued on May 8, 2018 to Steele; U.S. Pat. No. 8,613,547 entitled "Packages Having Bubble-Shaped Closures," issued on Dec. 24, 2013 to Steele; U.S. Pat. No. 7,883,268 entitled "Package Having a Fluid Actuated Closure," issued on Feb. 8, 2011 to Steele; and U.S. Pat. No. 7,207,717 entitled "Package Having a Fluid Actuated Closure," issued on Apr. 24, 2007 to Steele, the contents of which are hereby incorporated by reference in its entirety and for all purposes.

OBJECTS AND SUMMARY OF THE DISCLOSURE

It is therefore an object of the present disclosure to provide improvements in the field of bubble valve closures and packaging using bubble valve closures.

The presently disclosed embodiment is a package which allows for multiple liquids to be dispensed together. Through a combination of specific pouch construction and a pair of bubble valves used in tandem, multiple liquid types (by way of non-limiting example, differing viscosity, colors, scents, or even two components of a finished composition, such as epoxy) can be dispensed from the same base pouch at customer desired rates. The use of the valves as they are designed specifically allows for the individual flow rates of the two sides to be properly metered and balanced relative to one another per the application. This can include accounting for the different viscosities and/or the desire to have a specific blend of product in the finished dispense. Examples of applicable uses would be in the case of two distinct liquids mixing for an epoxy or, in the case of something such as cake decorating, two different colors of an icing being applied with improved side-by-side precision.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
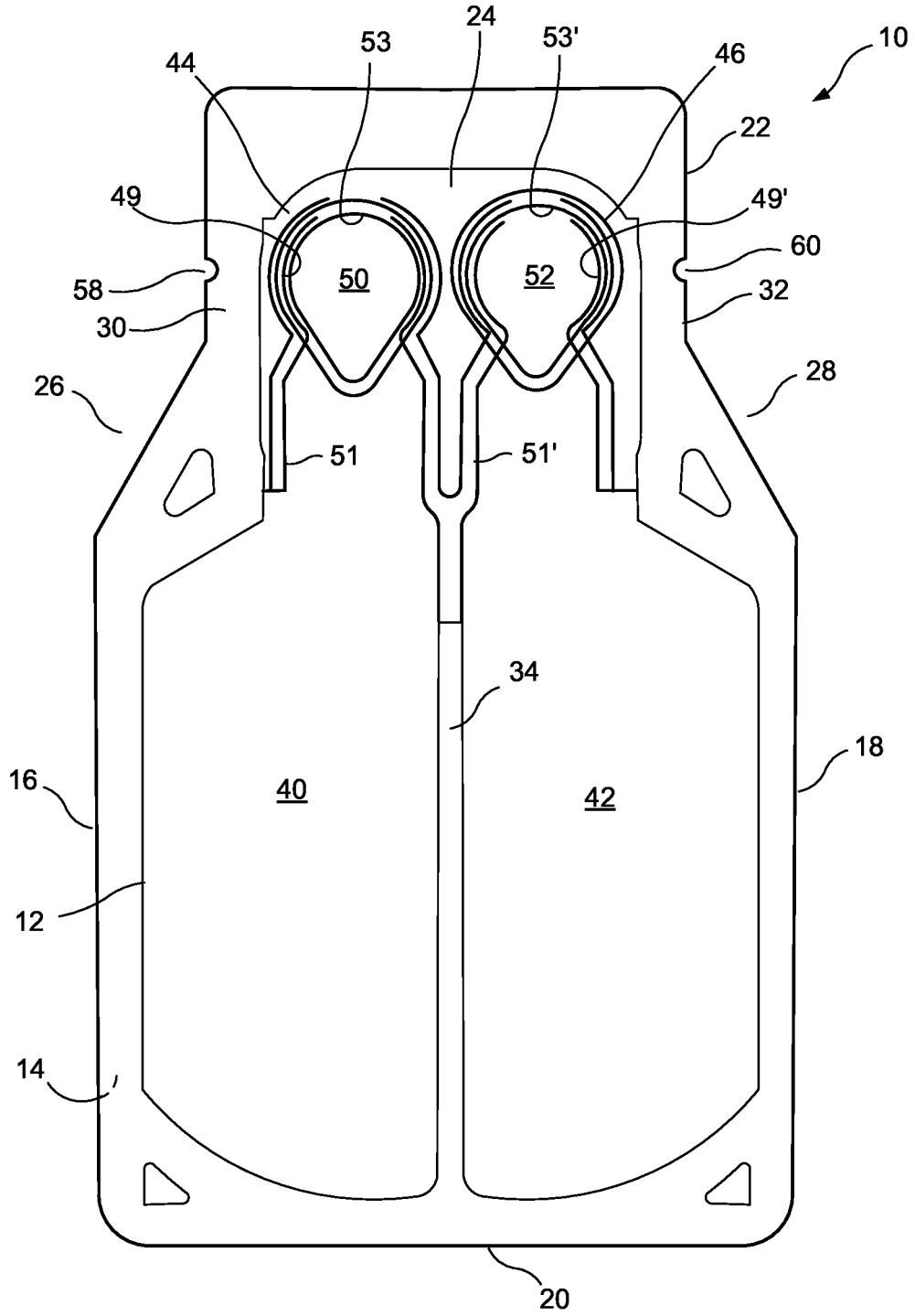
FIG. 1 is a plan view of a first embodiment of the present disclosure.

Referring now to the drawings in detail, one sees that FIG. 1 illustrates a first embodiment of the present disclosure. A package 10 (i.e., container) is provided wherein first and second co-extensive polymeric web panels 12, 14 are provided and sealed together by first and second side seals 16, 18 and bottom seal 20. The package 10 further includes a neck 22 with a fluid dispensing channel 24 wherein the first and second co-extensive polymeric web panels 12, 14 are sealed together at first and second oblique seals 26, 28 and first and second neck side seals 30, 32 thereby defining an interior volume. Additionally, a central seal 34 (i.e., a divider) is provided between the first and second co-extensive polymeric web panels 12, 14 thereby dividing the interior volume and defining first and second storage volumes 40, 42, both in fluid communication with the fluid dispensing channel 24. First bubble valve 44 controls flow from first storage volume 40 through fluid dispensing channel 24. Likewise, second bubble valve 46 controls flow from second storage volume 42 through fluid dispensing channel 24.

First and second bubble valves 44, 46 are additionally disclosed in PCT/US2017/61500, entitled "Bubble Valve for Flexible Packaging," filed on Nov. 14, 2017, the contents of which is hereby incorporated by reference in its entirety and for all purposes. See, in particular, FIGS. 3A-3D, 4A-4D, and 5A-5D. The second co-extensive polymeric web panel 14 can act as a base layer 14, with a bubble layer 13 sealed to the base layer 14 along bubble seals 49, 49', thereby forming first and second bubbles 50, 52 (or other protruding or pressure actuated device), typically with air, gas, liquid or other fluid trapped therewith. The first co-extensive polymeric web panel 12, sealed along channel seal 51, 51' to at least one of the base layer 14 and bubble layer 13, functions as a channel layer 12 thereby forming the bubble valves 44, 46, with the dispensed material passing from the first or second storage volume 40, 42 through a passageway formed between first or second bubble 50, 52 and first co-extensive polymeric web panel 12 (i.e., the channel layer) through first and second openings 53, 53'. A portion of the channel seal 51, 51' extends to the central seal 34 of the container 10.

As can be seen from FIG. 1, the channel seals 51, 51' may form different sized openings 53, 53' between the channel layer 12 and the first and second bubbles 50, 52, in order to provide for the possibility of dispensing more or less of one of the products, or to compensate for the increased or decreased viscosity of one of the dispensed products. The openings 53, 53' are adjacent to one another and are oriented for parallel dispensing of the dispensed products from the first and second storage volumes 40, 42.

Several physical characteristics of the first and second bubbles 50, 52 can be customized to the specific needs of the product and/or consumer or user requirements. In one embodiment, a position of the channel seals 51, 51' relative to the bubble seals 49, 49' is, for example, but not limited to, adjusted laterally or radially. In another embodiment, a width of the channel seals 51, 51' between the neck side seals 30, 32 and the central seal 34 (i.e., divider) is adjusted. The first and second storage volumes 40, 42 can be adjusted along with the widths of the channel seals 51, 51' by an offset positioning of the central seal 34. In yet another embodiment, the pressurization of the second bubble 52 is greater than the pressurization of the first bubble 50, thus dispensing less product from the second storage volume 42.

Additionally, the side neck seals 30, 32 of neck 22 may include indentations 58, 60 to define a line of weakness for the foldable header disclosed in PCT/US2018/037461 entitled "Pouch Flip-Top for Bubble Valve Applications," filed on Jun. 14, 2018, the contents of which is hereby incorporated by reference in its entirety and for all purposes.

Figure 2:
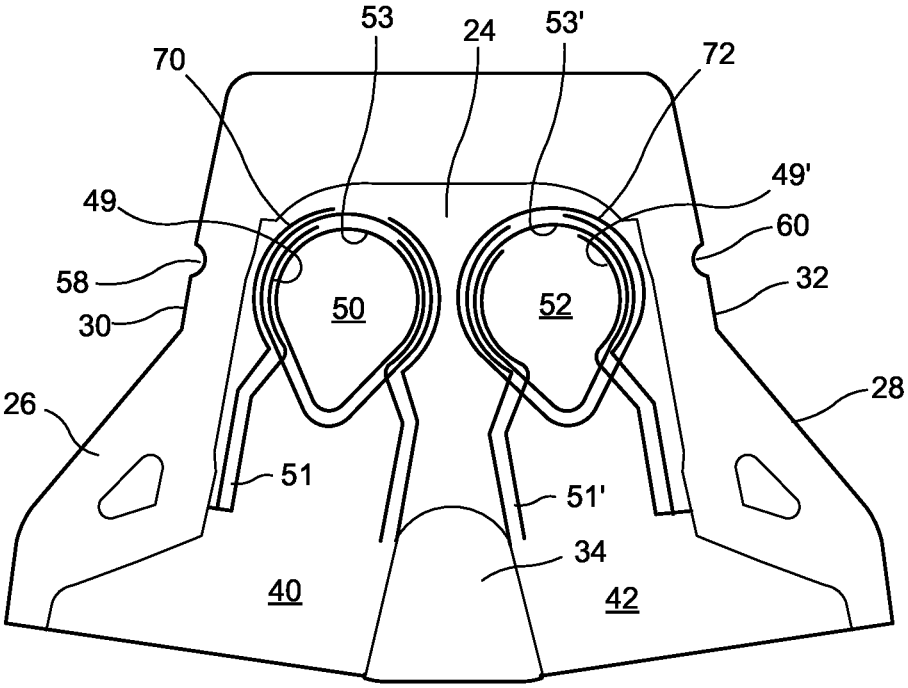
FIG. 2 is a plan view of a second embodiment of the present disclosure, including the valves at a tilted configuration.

FIG. 2 discloses an embodiment of the present disclosure with the first and second bubble valves 70, 72 being tilted approximately ten degrees toward each other. This may be advantageous in an epoxy application (i.e., the first and second components of epoxy being dispensed from respective first and second storage volumes 40, 42) or similar applications requiring a precise dispensing area, precise mixing, and control over the dispensed material. The first and second components from the first and second storage volumes 40, 42 may mix in the fluid dispensing channel 24 or just outside of the container 10.

Figure 3:
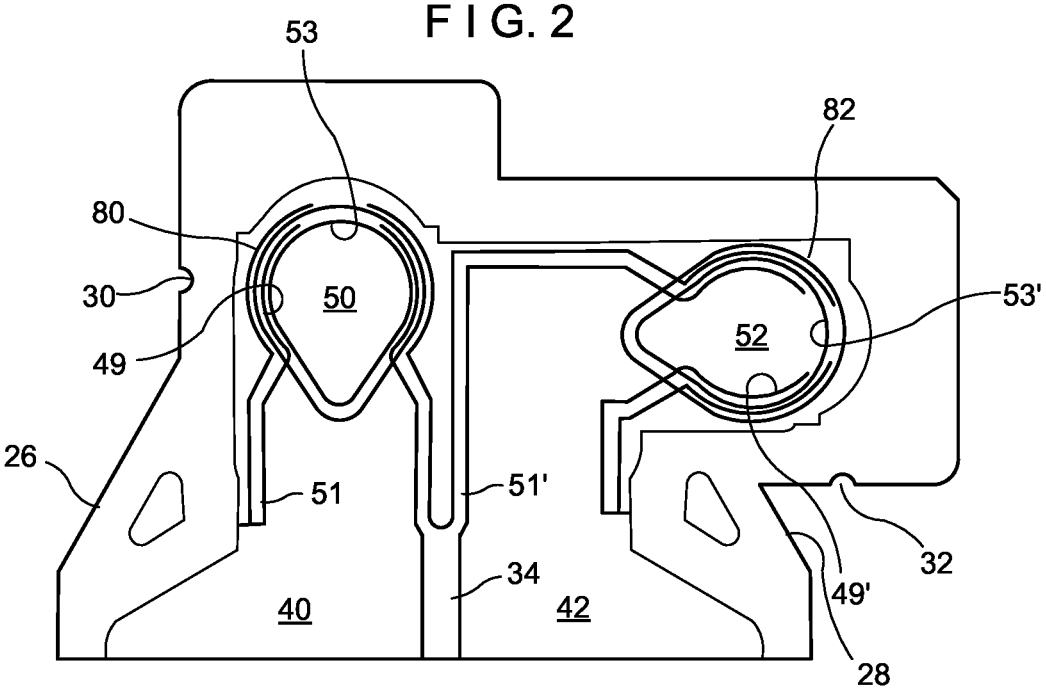
FIG. 3 is a plan view of a third embodiment of the present disclosure, including valves at an orthogonal configuration.

FIG. 3 discloses an embodiment of the container 10 and protruding element valves (i.e., bubble valves or pressure actuated valves) with first and second bubble valves 80, 82 being at right angles, or orthogonal to each other, with the second bubble valve 82 having a longer inlet. This embodiment may be useful for cake decorating, among other possible uses.

Figure 4:
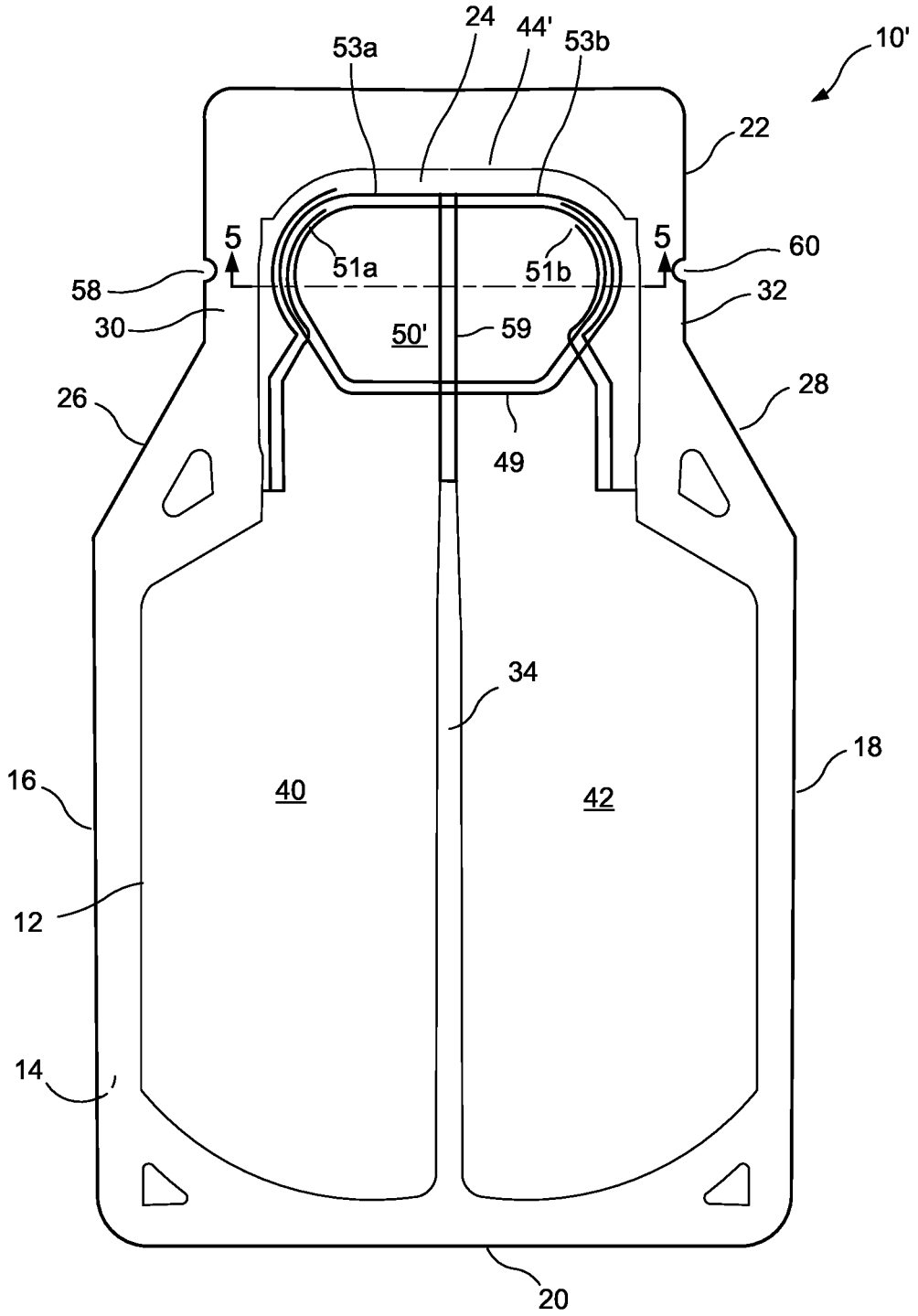
FIG. 4 is a plan view of a fourth embodiment of the present disclosure, with a single valve configuration.
Figure 5:
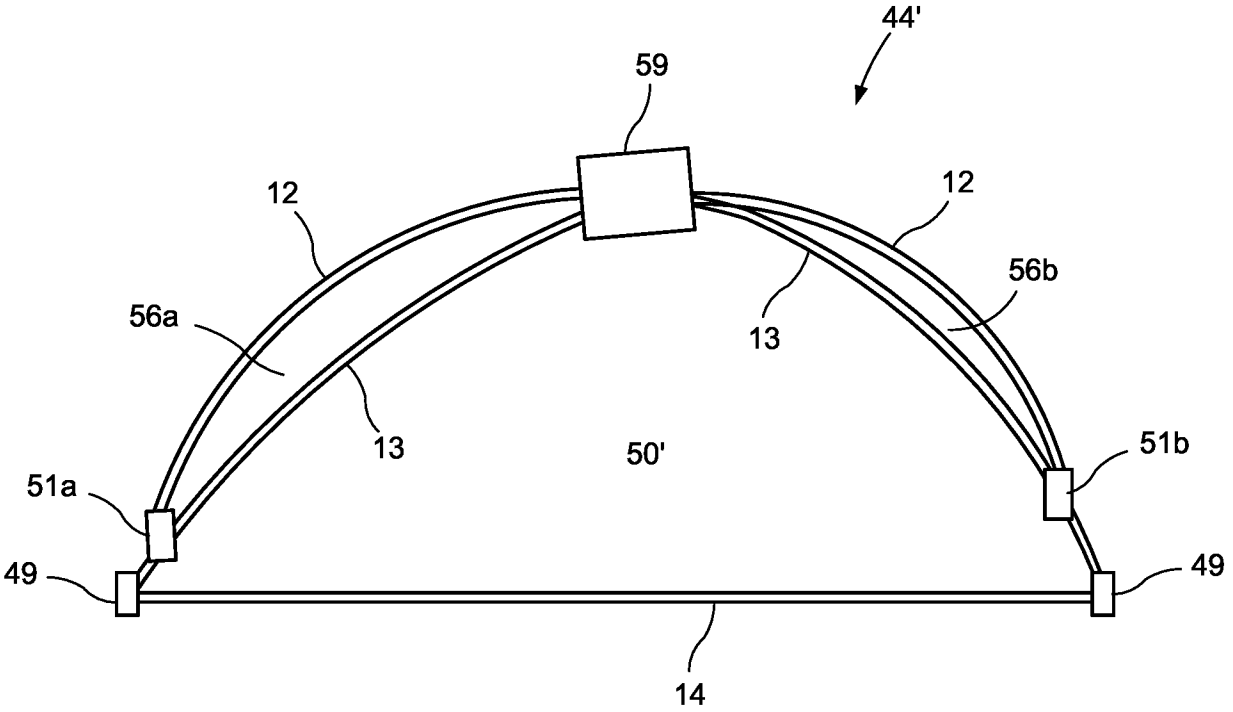
FIG. 5 is a cross-sectional view of the fourth embodiment of the present disclosure, as illustrated in FIG. 4

FIGS. 4 and 5 disclose an embodiment of a package 10' with a single widened bubble valve 44' and a longitudinal seal 59. A widened bubble 50' is formed between base layer 14 (i.e., second co-extensive polymeric web panel) and bubble layer 13. The longitudinal seal 59 is formed between the channel layer 12 (i.e., first co-extensive polymeric web panel) and the bubble layer 13, thereby creating first and second fluid passageways 56*a*, 56*b*. The extent of the left-hand portion of the channel seal 51*a* may be different from the extent of the right-hand portion of the channel seal 51*b* in order to vary the sizes of openings 53*a*, 53*b* as required by the application (e.g., the proportions of the dispensed material to be mixed, along with the viscosity thereof).

The widened bubble valve 44' includes the widened bubble 50' and a fluid dispensing channel 24. The bubble 50' is formed by a bubble seal 49 between the base layer 12 and the bubble layer 13. The fluid dispensing channel 24 includes a first fluid passageway 56*a* formed between the first channel seal 51*a* and the longitudinal seal 59 and a second fluid passageway 56*b* formed between the second channel seal 51*b* and the longitudinal seal 59. Contents from the first storage volume 40 pass through the first fluid passageway 56*a* and dispense from the first opening 53*a*, and contents from the second storage volume 42 pass through the second fluid passageway 56*b* and dispense from the second opening 53*b*. Cross-sectional areas of the fluid passageways 56*a*, 56*b* (illustrated in FIG. 5) may differ depending on a desired difference in dispensing volume (e.g., a two-part epoxy with a non-equal ratio between resin and hardener).

Several physical characteristics of the openings 53*a*, 53*b* and/or the fluid passageways 56*a*, 56*b* of the widened bubble valve 44' can be customized to the specific needs of the product and/or consumer or user requirements. In one embodiment, a position of the channel seals 51*a*, 51*b* relative to the bubble seal 49 is, for example, but not limited to, adjusted laterally or radially. In another embodiment, the longitudinal seal 59 is positioned offset of center of the widened bubble valve 44', thus creating both openings 53*a*, 53*b* and inlets of varying widths from the storage volumes 40, 42 to the respective portions of the widened valve 44'.

Figure 6:
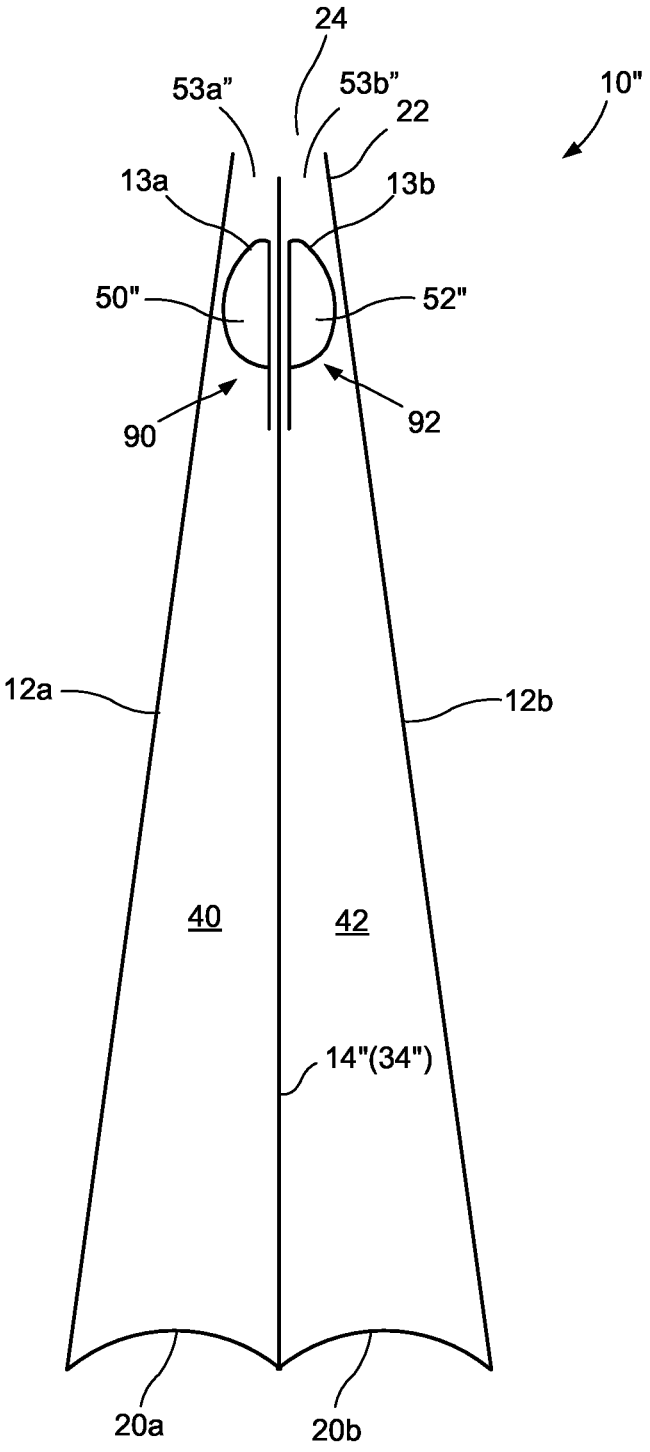
FIG. 6 is a side, cross-sectional view of a fifth embodiment of the present disclosure.

FIG. 6 discloses an embodiment of the present disclosure with first and second bubble valves 90, 92 being oriented "back-to-back" in a package 10" rather than "side-by-side" (as illustrated in FIG. 1). The package 10" (i.e., container) is provided wherein first and second co-extensive polymeric web panels 12*a*, 12*b* and gusset material 20*a*, 20*b* are sealed together thereby defining an interior volume. The package 10 further includes a neck 22 with a fluid dispensing channel 24. Additionally, a third co-extensive polymeric web panel 14" (also considered a divider 34") is provided between the first and second co-extensive polymeric web panels 12*a*, 12*b* thereby dividing the interior volume and defining first and second storage volumes 40, 42, both in fluid communication with the fluid dispensing channel 24. The first bubble valve 90 controls flow from first storage volume 40 through fluid dispensing channel 24. Likewise, the second bubble valve 92 controls flow from second storage volume 42 through fluid dispensing channel 24.

The third co-extensive polymeric web panel 14" can act as a base layer 14", with a first bubble layer 13*a* sealed to the base layer 14" along bubble seals (not shown; described above with respect to FIG. 1), thereby forming a first bubble 50". Similarly, a second bubble layer 13*b* sealed to the base layer 14" along bubble seals (not shown) forms a second bubble 52" (or other protruding or pressure actuated device) typically with air, gas, liquid or other fluid trapped therewith.

The first co-extensive polymeric web panel 12*a*, sealed along channel seal (not shown; described above with respect to FIG. 1) to at least one of the base layer 14" and first bubble layer 13*a*, functions as a channel layer 12*a* thereby forming the first bubble valve 90, with the dispensed material passing from the first storage volume 40 through a passageway formed between first bubble 50" and first co-extensive polymeric web panel 12*a* through first opening 53*a*". The second co-extensive polymeric web panel 12*b*, sealed along channel seal (not shown) to at least one of the base layer 14"

and second bubble layer 13*b*, functions as a channel layer 12*b* thereby forming the second bubble valve 92, with the dispensed material passing from the first storage volume 42 through a passageway formed between second bubble 52" and second co-extensive polymeric web panel 12*b* through second opening 53*b*". A portion of the divider 34" (i.e., the third web panel 14") extends through the valves 50",52" to the fluid dispensing channel 24 of the container 10".

Thus the several aforementioned objects and advantages are most effectively attained. Although preferred embodiments of the invention have been disclosed and described in detail herein, it should be understood that this invention is in no sense limited thereby.

What is claimed is:

1. A container comprising:

a first web panel;

a second web panel sealed to the first web panel, thereby forming an interior volume in communication with a fluid dispensing channel;

a divider within the interior volume thereby defining a first storage volume and a second storage volume;

a first protruding element valve in the fluid dispensing channel thereby controlling flow from the first storage volume through the fluid dispensing channel;

a second protruding element valve in the fluid dispensing channel thereby controlling flow from the second storage volume through the fluid dispensing channel; and wherein the first and second protruding element valves are respective first and second bubble valves, including a fluid passageway formed between a bubble layer and a channel layer.

2. The container of claim 1 wherein the bubble layer of the first and second bubble valves is attached to the second web panel, thereby forming respective first and second bubbles.

3. The container of claim 2 wherein the first web panel forms the channel layer of the first and second bubble valves.

4. The container of claim 3 wherein the first and second bubbles are filled with gas or fluid.

5. The container of claim 3 wherein there is a physical characteristic difference between the first protruding element and the second protruding element, and wherein more contents from the first storage volume are dispensed than contents from the second storage volume.

6. The container of claim 3 wherein the first and second bubble valves are arranged adjacent to each other.

7. The container of claim 6 wherein the first and second bubble valves dispense product from respective first and second storage volumes parallel to each other.

8. The container of claim 6 wherein first and second bubble valves are inclined toward each other to at least partially mix the products dispensed from respective first and second storage volumes.

9. The container of claim 1 wherein the divider is a central seal between the first and second web panels.

10. The container of claim 1 wherein the divider is a third web panel.

11. A container comprising:

a first web panel;

a second web panel sealed to the first web panel, thereby forming an interior volume in communication with a fluid dispensing channel;

a central seal within the interior volume thereby defining a first storage volume and a second storage volume;

a protruding element valve in the fluid dispensing channel thereby controlling flow from the first and second storage volumes through the fluid dispensing channel; and wherein the protruding element valve is a bubble valve, including first and second fluid passageways formed between a bubble layer and a channel layer, the first fluid passageway being in fluid communication with the first storage volume and the second fluid passageway being in fluid communication with the second storage volume, wherein the first and second fluid passageways are divided from each other by a longitudinal seal between the bubble layer and the channel layer.

12. The container of claim 11 wherein the bubble layer of the bubble valve is attached to the second web panel, thereby forming a bubble.

13. The container of claim 12 wherein the first web panel forms the channel layer of the bubble valve.

14. The container of claim 13 wherein the bubble is filled with gas or fluid.

15. The container of claim 11 wherein the first fluid passageway has a larger cross-sectional area than the second fluid passageway, and wherein more contents from the first storage volume are dispensed than contents from the second storage volume.

16. A protruding element valve for dispensing contents of a package, comprising:

a base layer, a bubble layer, and a channel layer;

a bubble formed between the base layer and the bubble layer by a bubble seal;

a first channel seal, a second channel seal, and a longitudinal seal between the first channel seal and the second channel seal; and a fluid dispensing channel formed between the bubble layer and the channel layer, including a first fluid passageway and a second fluid passageway, wherein the first and second fluid passageways formed in the fluid dispensing channel between the longitudinal seal formed and the first and second channel seals respectively.

17. The protruding element valve of claim 16, wherein the first fluid passageway has a larger cross-sectional area than the second fluid passageway.

18. The protruding element of valve of claim 16, wherein the first fluid passageway dispenses contents from a first storage volume of the package and the second fluid passageway dispenses contents from a second storage volume of the package.

* * * * *